United States Patent [19]

Platt

[11] Patent Number: 5,046,294

[45] Date of Patent: Sep. 10, 1991

[54] PERIMETER CLIP

[75] Inventor: William J. Platt, Aston, Pa.

[73] Assignee: National Rolling Mills, Inc., Frazer, Pa.

[21] Appl. No.: 522,765

[22] Filed: May 14, 1990

[51] Int. Cl.[5] ..... E06B 3/54

[52] U.S. Cl. ..... 52/489; 52/484; 52/665; 52/714

[58] Field of Search ..... 52/488, 489, 484, 668, 52/714, 715, 762, 766, 665; 403/247, 382, 403, 405.1

[56] References Cited

U.S. PATENT DOCUMENTS

| | | | |
|---|---|---|---|
| 3,798,865 | 3/1974 | Curtis | 32/484 X |
| 4,610,562 | 9/1986 | Dunn | 52/665 X |
| 4,715,161 | 12/1987 | Carraro et al. | 52/714 |

*Primary Examiner*—David A. Scherbel
*Assistant Examiner*—Creighton Smith
*Attorney, Agent, or Firm*—Eugene Chovanes

[57] ABSTRACT

A perimeter clip to tie the end of a beam in a dropped grid ceiling to an angle wall molding. The clip is in right angle form with one leg hooked to the molding and the other leg formed to receive and secure the end of a beam. The clip is desirably formed from a flat, stamped piece of metal.

6 Claims, 2 Drawing Sheets

40
41
42
43
45
46
47
52
53
55
56
60
61
62
63
65
66
67
68

40
41
42
43
45
47
50
51
53
55
60
61
62
65
66

40
41
43
45
47
48
50
51
53
65
68

40
41
43
45
46
47
53
54
55
56
65
66

40
41
42
43
47
48
50
52
53
60
61
62
63
65
68

40
41
43
45
46
47
60
61
63
65
66
67
68

PERIMETER CLIP

FIELD OF THE INVENTION

The invention relates to dropped ceilings of the grid type wherein metal beams are suspended from a structural ceiling. The beams are arranged in grid fashion to receive acoustical tiles supported by and located within the beams which are generally in the form of inverted T-shapes in cross section.

BACKGROUND OF THE INVENTION

Extensive use is made of suspended ceiling which are suitably supported below a structural ceiling in primarily industrial and commercial construction.

The suspended ceiling is formed of interlocking grid beam members generally of an inverted T-cross section. Such beam members are generally formed of strip steel suitably bent to provide a vertically extending web section, horizontally extending shoulders or flanges at the bottom of the web section, and a suitable reinforcing box member at the top of the web. Numerous different design interlocking structures are used to provide, when assembled, grid or structural members which are then supported from the structural ceiling by, for instance, a plurality of wires which are secured through holes in the web of the beam at the lower end and to anchors in the structural ceiling at the upper end. Acoustical tiles in the form of rectangles or squares are supported within and by the structural members whereby a suspended ceiling is formed below the structural ceiling.

Panel lighting, heating and ventiallating units can also be suitably located within and supported by the suspended ceiling.

The grid supporting structure of beams described above is generally formed within the vertical walls of the individual rooms of a building. Such walls include structural walls as well as interior partition walls. The suspended grid structure generally terminates at the edge of and within both the structural and partition walls. A wall molding having an angle cross section supports the grid beams at the ends thereof. An upper extending leg of the angle is fastened against the wall and the horizontal extending angle forms a ledge or flange which receives and supports the lower T-section of the beam.

The ends of the beams which abut the enclosing walls of the room rest on, and are supported by the wall molding.

SUMMARY OF THE PRESENT INVENTION

The present invention is a clip which connects and anchors the end of the beam that abuts against the wall to the angle wall molding that extends around the perimeter of the room.

The clip is desirably formed from a single, stamped flat piece of sheet metal, bent into the finished shape.

The clip is in general right-angle form wherein one leg of the right angle is hooked over the vertical web of the wall molding, and the other leg of the clip extents at right angles to the wall to receive the end of the grid beam. The beam is suitably secured in the clip by crimping opposing portions of the clip about a bulb portion of the beam web. In the alternative, the web of the beam can be cut at an angle, and then slit. A portion of the slit is then bent back in the clip.

DETAILED DESCRIPTION OF THE INVENTION

Figures 7, 8:
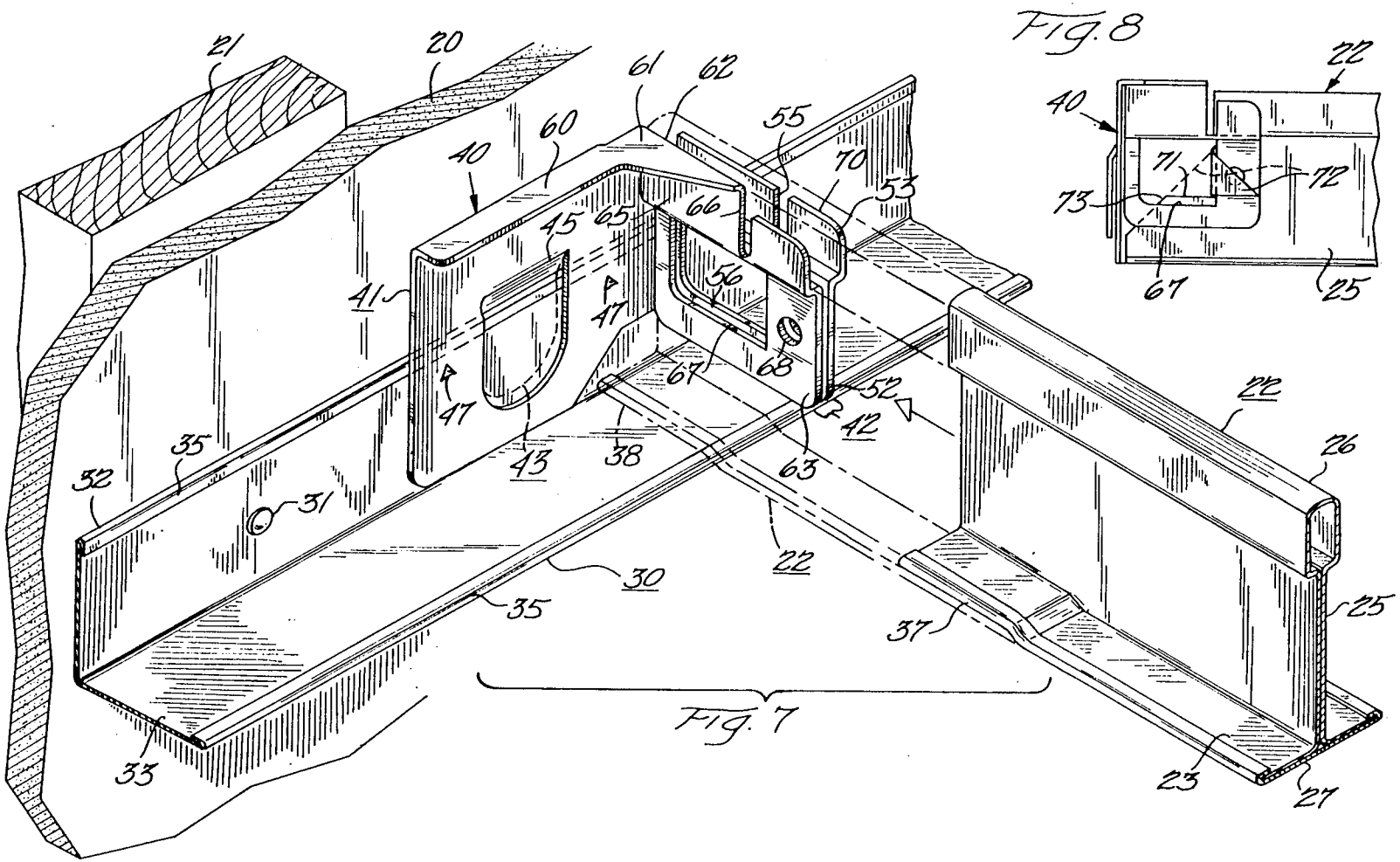
FIG. 7 is a fragmentary isometric view, illustrating a portion of drywall construction to which a fragment of a horizontally extending perimeter angle member is shown mounted. A right angle positioning and support clip, such as the clip shown in FIG. 1, is shown clipped to the vertical upstanding arm of the perimeter angle member, in some desired linear position. One terminal end of a ceiling tile support beam is shown in full lines, prior to being inserted within the positioning and supporting bifurcated leg of the support clip. There is shown in dot-and-dash lines the rest position of the beam after insertion within the confines of the bifurcated leg of the clip.
FIG. 8 is a side elevational view of the clip with a diagonally cut end beam in place and showing a bent-back tab.

As seen in FIG. 7, a vertical dry or plastered wall 20 is supported from structure 21. The wall 20 forms one side of a room within a building and extends from the floor to a structural ceiling.

A dropped ceiling of the grid type has a runner or beam 22 in the form of an inverted T. Beam 22 has a flange portion 23, a web portion 25, and a bulb portion 26. Beam 22 is suitably formed from a longitudinally extending flat strip bent to form the beam portions. A cover piece 27 is wrapped around the flange portion 23 of the beam and is painted in a desired color. Such beams are well known in the art and extend in grid fashion throughout the ceiling to form the grid structure for the acoustical tiles that are laid in the grids.

A wall molding 30 is secured to wall 20 by screws or fasteners 31. The wall molding 30 extends horizontally along the wall at the desired drop ceiling height. Molding 30 forms an angle in cross section having a vertical face 32 and a horizontal ledge 33. The molding 30 is formed of a continuously extending strip bent into folds 35 to form smooth edges, and bent at a right angle along the longitudinal center line to form face 32 and ledge 33. The face 32 and ledge 33 each are of a width equal to the width of the flange portion 23 of beam 22, so when the ceiling is in place, the wall molding ledge 22 and flange portion 23 appear identical.

Beam 33 has an offset portion 37, so that when beam 22 at its end is rested on shelf 33 as seen in phantom at 38 in FIG. 7, the lower surface of shelf 33 and flange portion 23 extends in the same plane to present a uniform appearance.

The perimeter clip 40 of the invention is used to secure the end of beam 22 to wall molding 30.

Figure 1:
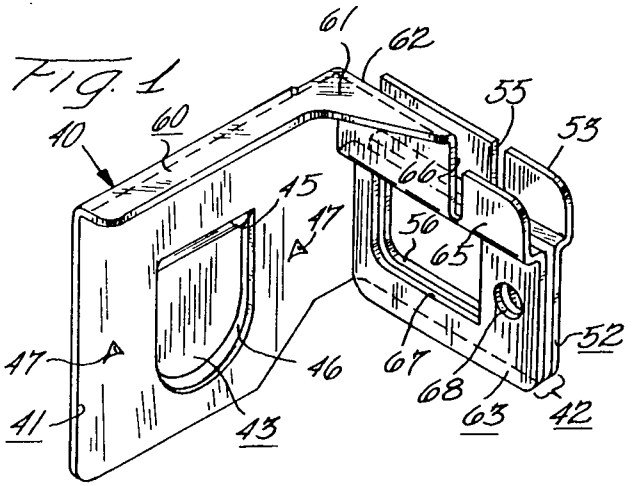
FIG. 1 is an enlarged isometric view of the clip of the invention.
Figure 3:
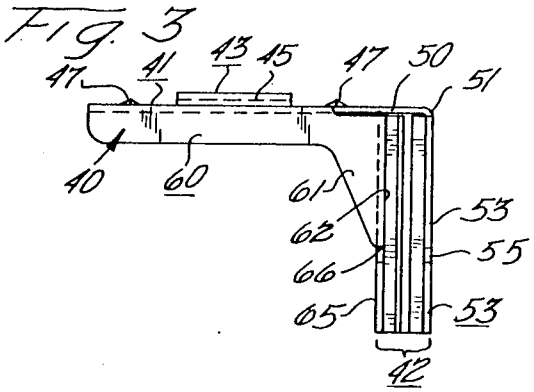
FIG. 3 is a plan view of the clip shown in FIG. 2.
Figure 5:
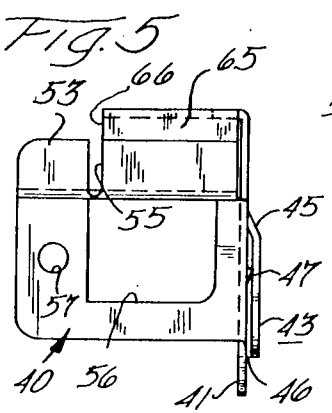
FIG. 5 is a right-hand elevational view of the clip shown in FIG. 2.
Figure 2:
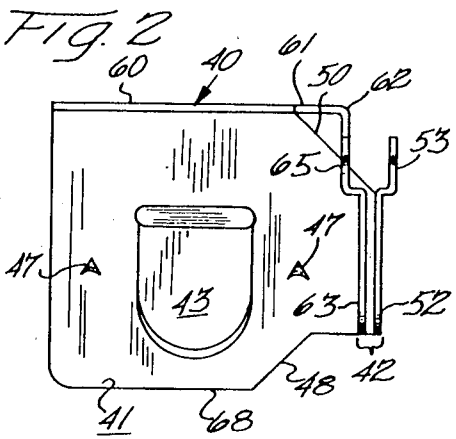
FIG. 2 is a front elevational view of the clip shown in FIG. 1.
Figure 4:
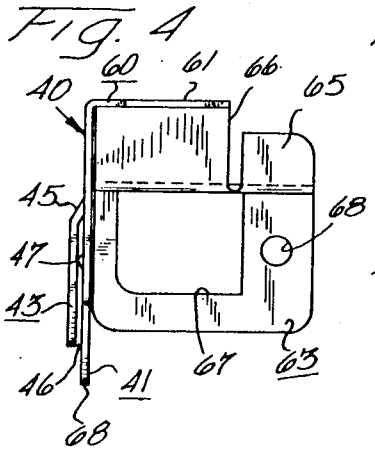
FIG. 4 is a left-hand elevational view of the clip shown in FIG. 2.

Clip 40, as seen particularly in FIGS. 1, 3 and 7, is in the form of a right angle having legs 41 and 42. Leg 41 is of a single thickness of sheet metal and has a tab or ear 43 lanced out in a U-shape with the top of the U at 45 remaining integral with leg 41. A space 46 as seen particularly in FIGS. 4 and 5, slightly smaller in thickness than the thickness of face 32 of molding 30 is formed by tab 43.

Figure 6:
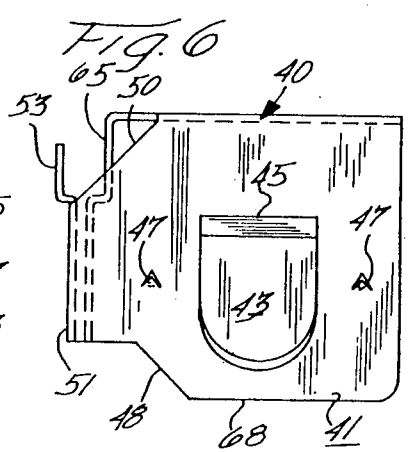
FIG. 6 is a rear elevational view of the clip as viewed from the right-hand side of FIG. 5.

Relatively small, pointed barbs 47 are lanced on each side of the tab 43. The points of barbs 47 are pointed upward in the clip. Leg 41 is generally rectangular in shape, except for reduced sections 48 and 50 formed by cutting out corresponding portions of metal. Reduced sections 48 and 50, as seen for instance in FIG. 6, are joined by an edge 51 that has extending therefrom one opposing web 52 of leg 42. Web 52 has at its top thereof, offset 53. Vertical slot 55 is formed in offset 53. Rectangular cutout 56 and hole 57 are formed in web 52.

Leg 41 has formed at the top thereof bent portion 60 extending toward leg 42. Section 61 of portion 60 has an edge 62 that is connected to opposing web 63 of leg 42. Web 63 has an offset portion 65 corresponding to offset 53 on web 52. Offset 65 has vertical slot 66 corresponding to slot 55. Web 63 has a cutout 67 and hole 68 corresponding to cutout 56 and hole 57.

The perimeter clip of the invention is applied to the vertical face 32 of wall molding 30 by snapping tab 43 downward on the face until barbs 47 ride over upper fold 35 and, tab section 45 rests on the upper fold 35, and the bottom edge of leg 41 rests on shelf 33 as seen in FIG. 7.

Clip 40 is positioned on the molding 30 at a point predetermined by the intended position of the dropped ceiling grid. For instance, where the beams are interconnected to form a 2'×4' grid, the clips will be spaced at 4' intervals along one set of opposing walls, and at 2' intervals on the other set of opposing walls, in a rectangularly shaped room.

The ends of the beams 22 are inserted into the clip as seen in FIG. 7, in the direction of the arrow. Web 25 of beam 22 is inserted between opposing webs 52 and 63 of leg 42, and bulb 26 of the beam engages opposing offsets 53 and 65. The webs 52 and 63 are so spaced from one another as to provide a snug, springy fit about the beam. Offset flange portion 37 of the beam clears legs 41 and 42 as shown and rests on shelf 33.

Opposing offset portions 53 and 65 may be crimped by pliers or the like at 70 to slightly crush an adjoining section of bulb 26 to lock the beam to the clip.

Alternative means for locking the beam 22 to the clip 40 include passing a screw or wire through the web 25 and matching holes 57 and 68 in leg 42.

Still another way of locking the beam to the clip, as seen in FIG. 8, is by slitting the end of the web 25 horizontally at 71 to form a tab 72 that can be bent back longitudinally through opening 56 or 67 in the clip. The end of beam 22 is desirably cut at an angle 73 to permit easy access to tab 72 for bending.

In determining the lengths of the beams 22 to be inserted into the clips, a string line or the like may be stretched generally parallel to the wall molding at a prefigured distance, and then the exact distance from the string to the face 32 of the molding 30 computed at each clip position. In this manner, a straight, secure, first course of beam can be horizontally tied to the wall molding so that subsequent, pre-cut, exact length beams can be interlocked one to another to form an exact grid ceiling. The final beams at the opposing wall are cut to the distance required to tie into the opposing wall clips and complete the ceiling.

It should be understood that the clip disclosed is desirably formed of a stamped, pre-cut flat sheet metal piece which is then successfully bent to the form shown.

I claim:

1. For use in a dropped grid ceiling for a room with a perimeter wall, the ceiling having
   (1) intersecting beams of inverted T-shape with a flange and a web, and
   (2) a right angle wall molding having a wall face and a support ledge fastened to the wall; a perimeter clip formed from a single piece of sheet metal for securing a beam end to the wall molding comprising
      (a) a first leg having a top and side, and a second leg positioned at right angles to the first leg, said top being perpendicular to said side of said first leg;
      (b) the first leg having tab means for securing the first leg to the wall molding wall face wherein the wall molding wall face and the first leg lie in abutting parallel relationship, and the bottom of the leg rests on the wall molding support ledge;
      (c) the second leg formed
         (1) from a bend at the top of the first leg and a bend at the side of the first leg and
         (2) into opposing clip webs extending
            (a) parallel to one another, and
            (b) at right angles to the first leg, the distance between the clip webs being substantially equal to the thickness of the beam web;

wherein the end of the beam is secured at its web between the clip webs, and the flange of the beam rests on, and is supported by, the wall molding ledge.

2. A clip of claim 1 having means for locking the beam end in the clip.

3. A clip of claim 2 wherein said means include an offset portion to receive a bulb portion of the beam, wherein the offset portion and the bulb portion can be crimped together.

4. A clip of claim 2 wherein the second leg has a cutout portion wherein a tab in the beam end can be bent through the cutout portion.

5. A clip of claim 1 having means for locking the first leg to the wall molding face comprising cutout barbs.

6. A clip of claim 1 wherein the first and second leg have cutout portions to permit the flange of the beam end to avoid interference with the clip when the flange rests on the wall molding ledge.

* * * * *